US007516516B2

(12) United States Patent
Wu

(10) Patent No.: US 7,516,516 B2
(45) Date of Patent: Apr. 14, 2009

(54) THREE-DIMENSION ADJUSTABLE HIDDEN FURNITURE DOOR HINGE

(76) Inventor: Zhiyong Wu, 1,HE AN Industry RD. 1, Dongfeng, Leliu, Shunde, Foshan, Guangdong (CN) 528300

( * ) Notice: Subject to any disclaimer, the term of this patent is extended or adjusted under 35 U.S.C. 154(b) by 482 days.

(21) Appl. No.: 11/320,724

(22) Filed: Dec. 30, 2005

(65) Prior Publication Data

US 2006/0143859 A1 Jul. 6, 2006

(30) Foreign Application Priority Data

Jan. 4, 2005 (CN) ..... 2005 2 0053374

(51) Int. Cl.
*E05D 7/04* (2006.01)

(52) U.S. Cl. ..... 16/242; 16/238; 16/382; 16/338

(58) Field of Classification Search ..... 16/242, 16/235, 245, 240, 246, 250, 271, 286–288, 16/272, 238, 382, 338, 340; 312/319.1, 319.2, 312/326, 329

See application file for complete search history.

(56) References Cited

U.S. PATENT DOCUMENTS 3,890,670 A * 6/1975 Sewing et al. ..... 16/236
4,620,343 A * 11/1986 Grass ..... 16/236
6,637,073 B2 * 10/2003 Kincaid ..... 16/250
6,647,591 B1 * 11/2003 Domenig et al. ..... 16/242
6,845,544 B2 * 1/2005 Hofer ..... 16/246
7,017,231 B2 * 3/2006 Isele ..... 16/242
7,213,300 B1 * 5/2007 Domenig et al. ..... 16/236
2003/0233731 A1 * 12/2003 Cotton ..... 16/250
2004/0154129 A1 * 8/2004 Martinez-Munoz ..... 16/250

* cited by examiner

*Primary Examiner*—Victor Batson
*Assistant Examiner*—Emily M Morgan
(74) *Attorney, Agent, or Firm*—IP Fortune LLC; Ruay Lian Ho

(57) ABSTRACT

A three-dimension adjustable hidden furniture door hinge is designed to include a travel member that can be fixed onto the door, an adjustable member that can be fixed onto the door frame and an arm segment connects these two members, the adjustable member includes three tiers of boards, a base board in the lower tier can be fixed onto a door frame, a middle board in the middle tier that can slide up and down on top of the base board, and an adjustable board in the upper tier on top of the middle board that can slide back and forth; there are matching grooves and directional tabs formed on the boards; three cam screws are used to provide up-down, back-forth, and left-right position adjustment, there is no need to loosen up other screws, the entire adjustment process is simple, quickly and energy saving.

18 Claims, 6 Drawing Sheets

THREE-DIMENSION ADJUSTABLE HIDDEN FURNITURE DOOR HINGE

FIELD OF THE INVENTION

The present invention relates to a hidden hinge for fixing wooden furniture, particularly, relates to a three-dimension adjustable hidden furniture door hinge.

BACKBROUND OF THE INVENTION

There are various types of hidden furniture door hinges with different structures. Such as the "hidden furniture door hinge" disclosed in patent application publication 03237822X, which includes a flexible member that can be fixed onto the bottom of a door, a fixed member that can be fixed onto a door frame, and a hinge arm that connects these two members; the fixed member can be formed with an adjustable member and a fixed board, the adjustable member is in a "中" shape, which has a T shape groove at its bottom, wherein the fixed board is rectangular, flanked with retaining walls, the T shape groove is inserted into the adjustable member and capable of sliding and shifting with the adjustable member. This "hidden furniture door hinge" disclosed by 03237822X can only be adjusted in two dimensions; the need of three dimensional adjustment for high end furniture cannot be satisfied. Hence, it is necessary to further develop and perfect the disadvantages of the current technology.

SUMMARY

It is an object of the present invention to provide a hidden furniture hinge with simple reasonable structure, which not only can be three dimensionally adjusted, but quickly and conveniently adjusted in order to overcome the disadvantages of the current technology.

A three-dimension adjustable hidden furniture door hinge is then developed based on this object, which includes a travel member that can be fixed onto the door, an adjustable member that can be fixed onto the door frame and an arm segment that connects the travel member and the adjustable member, the structure is characterized in that the adjustable member includes three tiers of boards, a base board in the lower tier can be fixed onto a door frame, a middle board in the middle tier that can slide up and down on top of the base board, and an adjustable board in the upper tier on top of the middle board that can be slid back and forth; there are matching grooves and directional tabs formed at these boards; the shape of the adjustable board is similar to a shovel, the arm segment is a curve rectangular, the arm segment is connected to the shovel handle portion of the adjustable board on one end, and hinge connected to the travel member on the other end; there are up-down, back-forth, and left-right three-direction cam screws coupled with the adjustable member, which coordinates with the arm segment to accomplish the three dimensional adjustment of the doors.

Said shovel shape adjustable board has three edges bending downward, and inward restrictive projections are formed in two opposite edges of these three, adjustable board has directional tabs formed on the bottom member of the shovel, the middle board is inserted into the space between the bottom member of the shovel and the directional tabs; there are two concave slide-in grooves formed at the two sides of the handle member of the shovel, the arm segment is slid into the slide-in grooves, and connected and fastened by a cam screw, turning this cam screw can accomplish the left-right position adjustment of the doors.

Grooves are formed on two sides of the base board, and a central aperture formed in the center, at least two legs extend downward to align with door frames; the middle board contains directional tabs that match with the grooves of the base board and grooves that match with the adjustable board, the front side-edge of the middle board bending downward to form grooves to match with the base board, the middle board is connect to the base board by another cam screw, the up-down position adjustment of the doors can be accomplished by turning the cam screw; the other two side-edges of the middle board contain flanges that can be snapped into the adjustable board and slid with it; the adjustable board is then connected to the middle board through screwing another cam screw, the back-forth position adjustment of the doors can be accomplished by turning this cam screw.

The adjustable member of the present product is consisted of three tiers of boards that include the base board, the middle board, and the adjustable board, turning the cam screws will cause sliding and shifting on these tiers of boards, which drives the door to carry out the up-down, back-forth, and left-right position adjustments, the arm segment is a curve rectangular, which is a material saving, low cost and more reasonable structure. The present invention provides three dimensional adjustments of doors simply by turning the cam screws, there is no need to loosen up other tightened screw, the adjustment process is quick and simple, energy and effort saving. In addition, a dust preventing decorating cover is provided, convenient for cleaning and hygiene.

DETAILED DESCRIPTION OF THE DRAWINGS

DETAILED DESCRIPTION OF THE INVENTION

The present invention can be further described in details by combining following attached drawings with the preferred embodiments.

Figure 6:
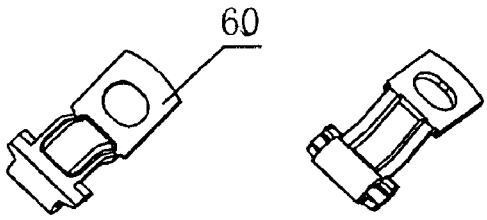
FIG. 6 illustrates the three-dimension front and back views of the structural schematic diagram of the arm segment.
Figure 9:
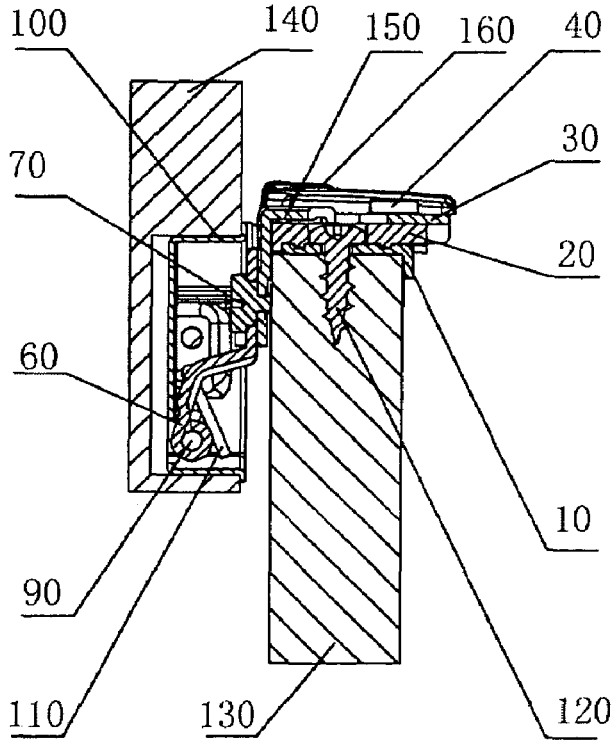
FIG. 9 illustrates the structural schematic diagram of a furniture door and the door frame of the present invention (when the door is closed)
Figure 10:
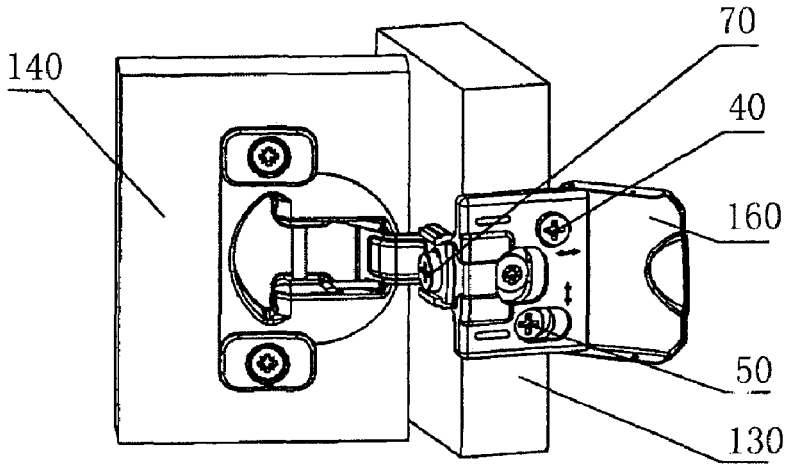
FIG. 10 illustrates the structural schematic diagram of a furniture door and the door frame of the present invention (when the door is open)

Referring to FIG. 1, FIG. 2, FIG. 9 and FIG. 10, a three-dimension adjustable hidden furniture door hinge includes a travel member 100 that can be fixed onto a door 140, an adjustable member 150 that can be fixed onto the door frame 130 and an arm segment 60 that connects the travel member and the adjustable member. The adjustable member 150 includes three tiers of boards, a base board 10 that can be fixed onto a door frame, a middle board 20 that can slide up and down on the base board, and an upper adjustable board 30 that can slide back and forth on the middle board; mutually matched grooves and directional tabs are formed on these boards. The shape of the adjustable board 30 is similar to a shovel, the arm segment 60 is a curve rectangular, as shown in FIG. 6, the arm segment 60 is inserted into and connected to the shovel handle member 31 of the adjustable board 30 at one end, and forming an aperture for connecting to the travel member 100 at the other end. The adjustable member 150 contains up-down, back-forth, and left-right three directions cam screws 50, 40, and 70, which can be coupled with the arm segment 60 to accomplish the three-dimensional adjustment of the door 140. The two torsion springs 80 and 110 are fastened inside the travel member 100 by utilizing a U shape pivot axis 90. In FIG. 9, legend 120 indicates a fastening screw.

Figure 3:
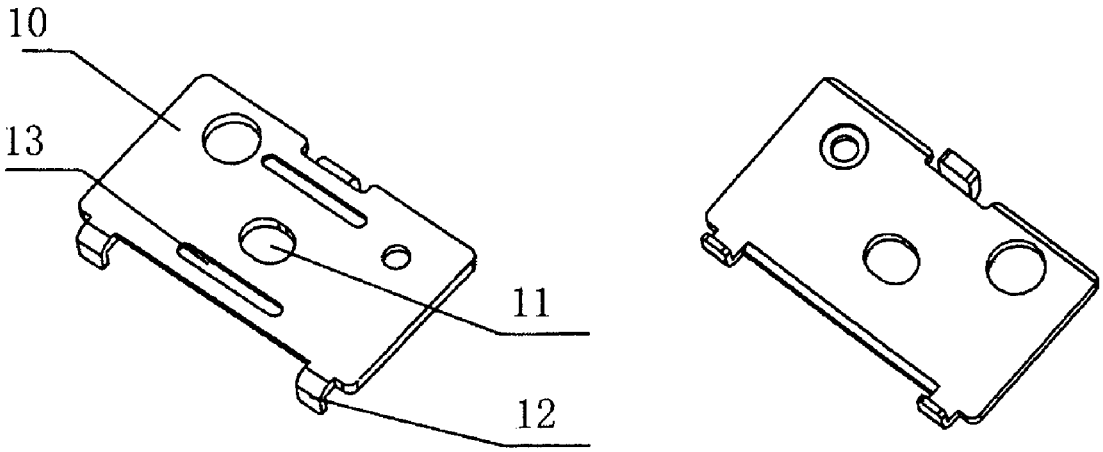
FIG. 3 illustrates the three-dimension front and back views of the structural schematic diagram of the base board.
Figure 4:
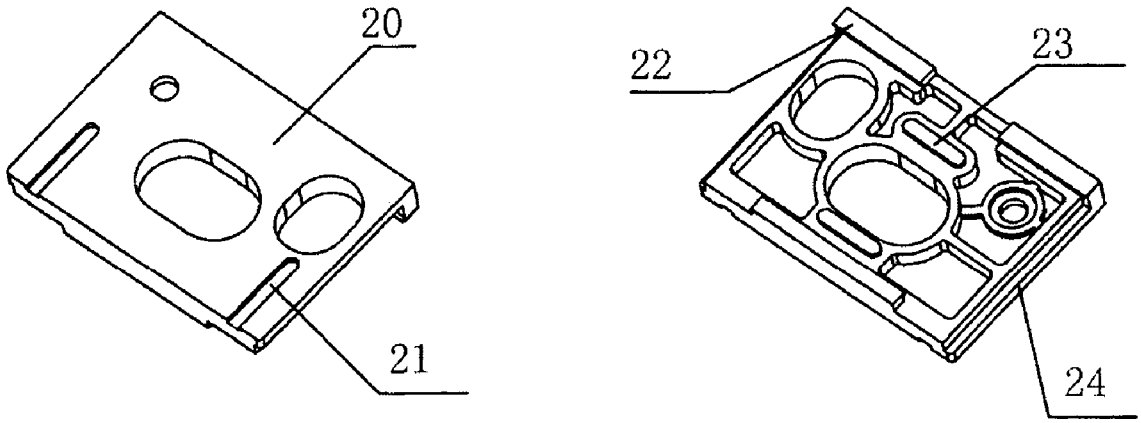
FIG. 4 illustrates the three-dimension front and back views of the structural schematic diagram of the middle board.

The base board 10 contains grooves 13 at its two sides, a central hole 11 for the fastening screw, and two legs 12 extending downward to align with the door frame, which can also be designed as a tripod with three legs bending downward, as shown in FIG. 3. The middle board 20 contains directional tabs 23 that match with the grooves 13 of the base board 10, and also contains grooves 21 that match the adjustable board 30, the front side-edge of the middle board bending downward 22 and forming two concave grooves between the downward bending and the middle board, as shown in FIG. 4, in order to match with the base board 10, through screwing another cam screw 50 to connect to the base board 10, turning the cam screw 50 will cause the middle board 20 and the base board 10 to slide and shift, the up-down position adjustment of the door can therefore be accomplished. The other two side-edges of the middle board 20 contain flanges 24 that can be snapped into the adjustable board and slide with it, through screwing another cam screw 40 the adjustable board 30 is connected to the middle board, turning the cam screw 40 will cause the adjustable board 30 and the middle board 20 to slide and shift, the back-forth position adjustment of the door can then be accomplished.

Figure 5:
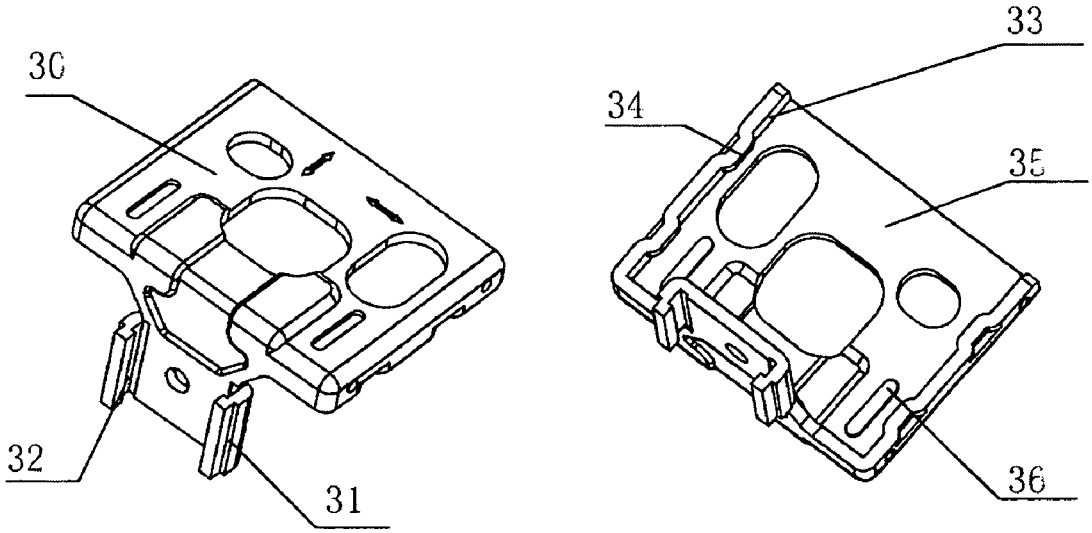
FIG. 5 illustrates the three-dimension front and back views of the structural schematic diagram of the adjustable board.

As shown in FIG. 5, three edges 33 of the shovel shape adjustable board 30 are bending downward, inward restrictive projections 34 are thus formed in the two opposing side members, directional tabs 36 are formed on the two sides of the shovel bottom member 35 of the adjustable board. The middle board is inserted into the space between the adjustable board shovel bottom member and the inward restrictive projections; concave slide-in grooves 32 are formed on the two sides of the shovel handle member of the adjustable board, one end of the arm segment is inserted into the concave slide-in groove, and connected and fastened by a cam screw 70, turning the cam screw 70, causing the shovel handle portion of the adjustable board and the arm segment to slide and shift, the left-right position adjustment of the door can then be accomplished.

Figure 7:
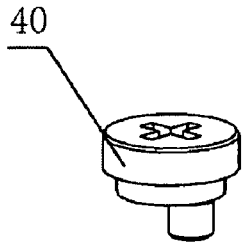
FIG. 7 and FIG. 8 illustrate the enlarged structural schematic diagram of two kinds of cam screws.
Figure 8:
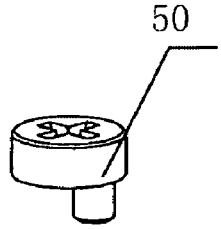

The cam screws are cam style screws, with a straight groove or a cross groove on top, three cam screws are positioned as a triangle. The cam screws 40, 70 are two-step cam screws, as shown in FIG. 7, the cam screw 50 is a one-step cam screw, as shown in FIG. 8.

Figure 1:
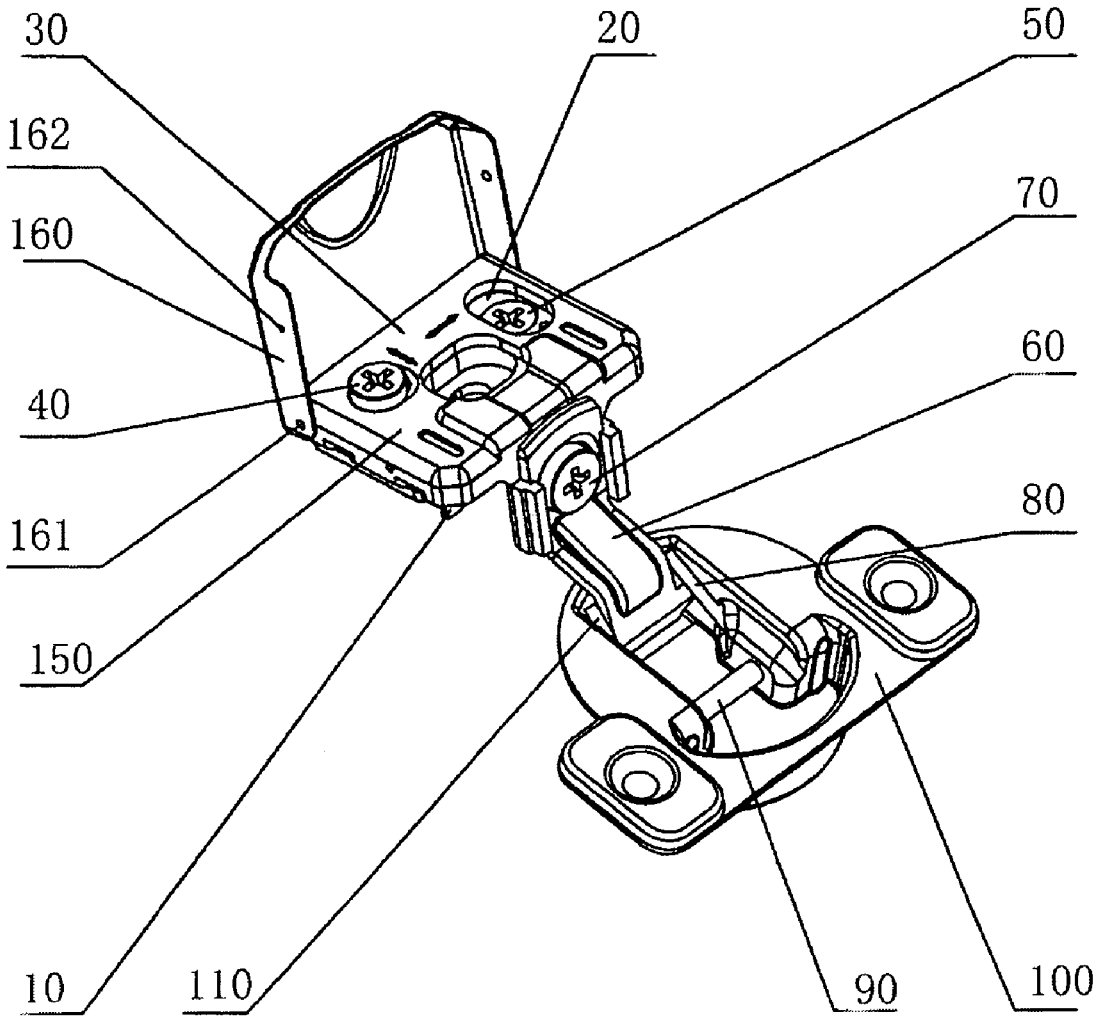
FIG. 1 illustrates the structural schematic diagram of a preferred embodiment of the present invention.
Figure 2:
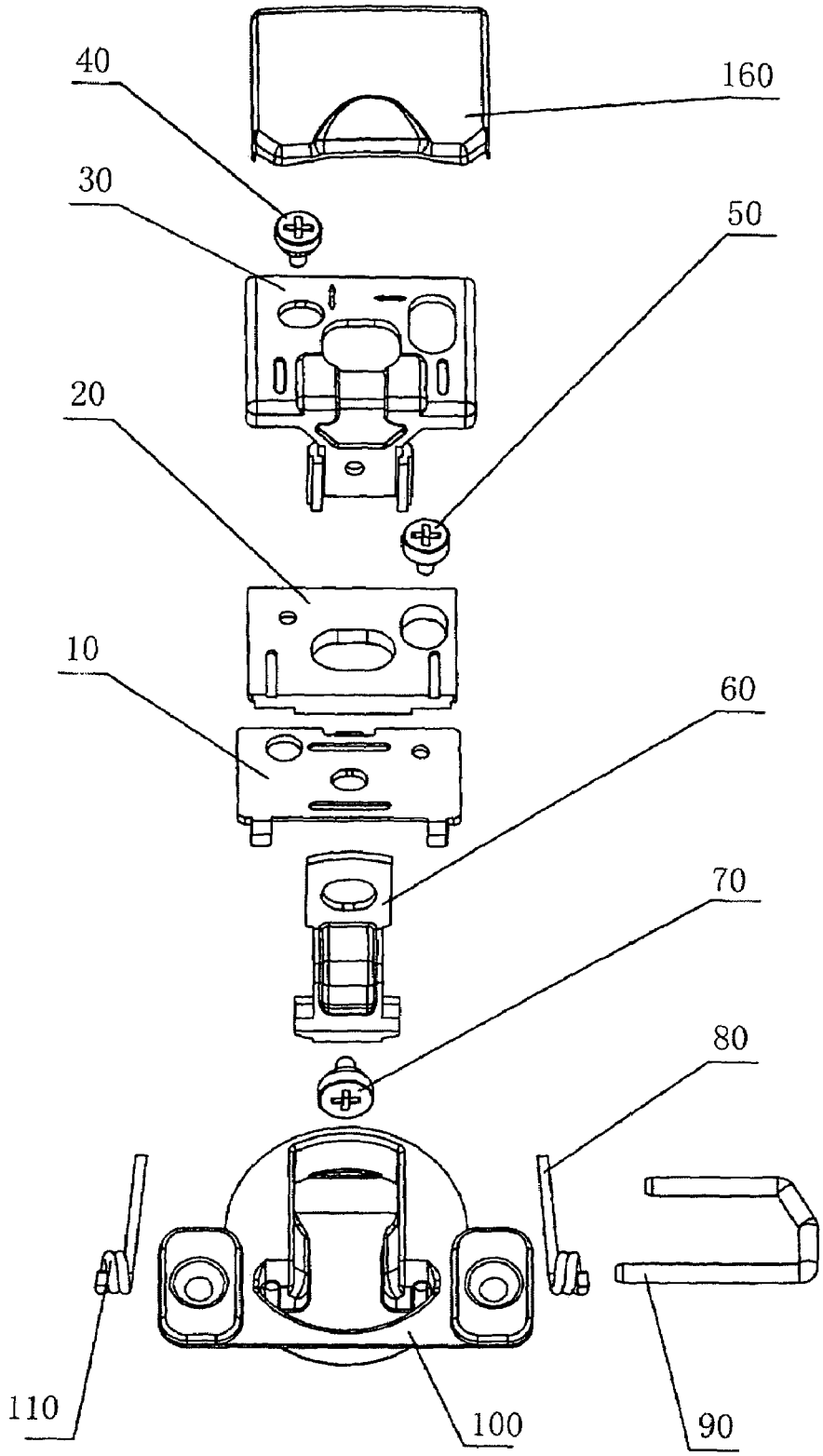
FIG. 2 illustrates the structural schematic diagram of various parts in FIG. 1.
Figure 11:
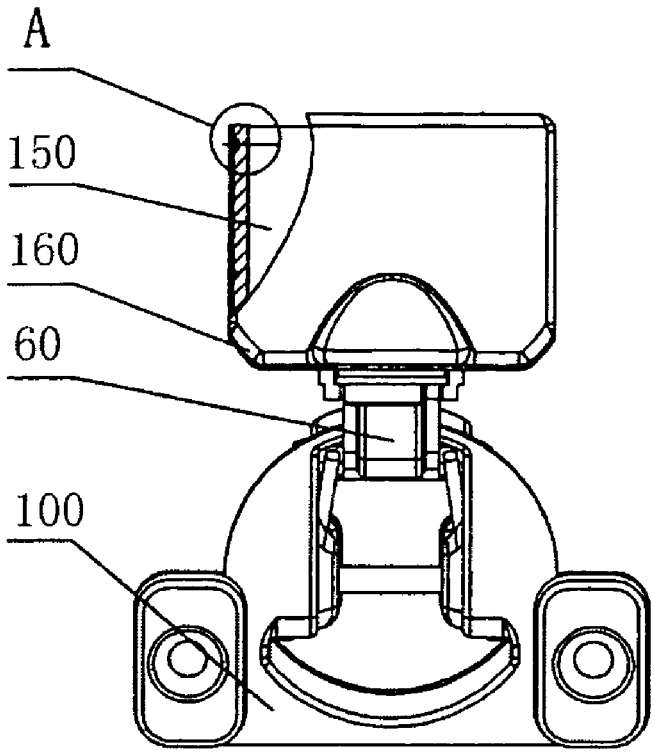
FIG. 11 illustrates the structural schematic diagram of the closed dust prevention cover of FIG. 1.
Figure 12:
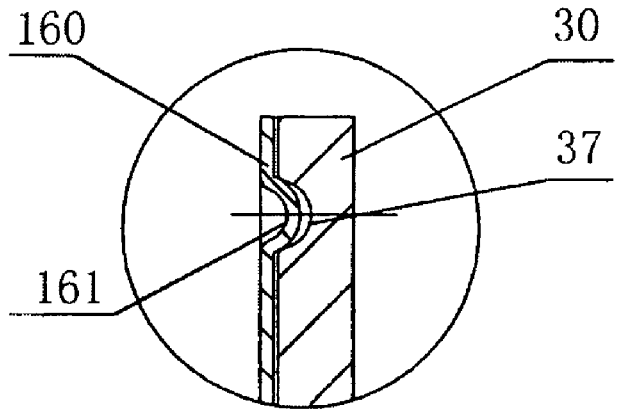
FIG. 12 illustrates the enlarged structural schematic diagram of part A in FIG. 11.

Referring to FIG. 1, FIG. 11, FIG. 12, the adjustable member 150 is installed with a dust prevention cover 160. Two or three edges of the dust prevention cover 160 are bending downward, connecting convex nails 161 are formed on one end of the curving edges, the adjustable board 30 is having concave points 37 at corresponding positions, the described convex nails match the concave points to accomplish connection, tabs 162 are formed on the other end of the curving edge so that the cover can be snapped onto the adjustable board.

What I claim is:

1. A hidden furniture door hinge comprises:

a travel member;

an adjustable member, including a plurality of tiers of boards and a plurality of cam screws, capable of three-dimension adjustment; an arm segment connecting the travel member and the adjustable member: and a dust prevention cover, wherein at least two side-edges of the dust prevention cover bend downward, a plurality of connecting convex nails formed on one end of edges, the nails matching a plurality of concave points formed the corresponding positions of the adjustable board to connect; and are formed to snap and close onto the adjustable board.

2. The hidden furniture door hinge as claimed in claim 1, wherein the adjustable member further comprises a base board, and a middle board, the middle board can slide up and down on the base board.

3. The hidden furniture door hinge as claimed in claim 2, wherein the adjustable member further comprises an upper tier adjustable board, the adjustable board can slide back and forth on the middle board.

4. The hidden furniture door hinge as claimed in claim 3, wherein the adjustable member further comprises a plurality of grooves and a plurality of matching directional tabs on the plurality of tiers of boards.

5. The hidden furniture door hinge as claimed in claim 4, wherein the adjustable member can be fixed onto a furniture door frame.

6. The hidden furniture door hinge as claimed in claim 3, wherein the adjustable board has three side-edges bending downward, and a plurality of inward restrictive projections are formed on the two opposing side-edges.

7. The hidden furniture door hinge as claimed in claim 6, wherein the adjustable board is in a shovel shape, including a bottom member and a handle member.

8. The hidden furniture door hinge as claimed in claim 7, wherein the shovel bottom member of the adjustable board contains directional tabs on its two sides.

9. The hidden furniture door hinge as claimed in claim 8, wherein the middle board is inserted into the space between the shovel bottom member and the plurality of inward restrictive projections.

10. The hidden furniture door hinge as claimed in claim 9, wherein the adjustable board further contains concave slide-in grooves on the two sides of its shovel handle member.

11. The hidden furniture door hinge as claimed in claim 10, wherein one end of the arm segment is inserted into the slide-in grooves, and connected and fastened by screwing a first cam screw to accomplish left and right adjustment.

12. The hidden furniture door hinge as claimed in claim 2, wherein the base board further contains a plurality of grooves and a central hole for fastening screw, a plurality of legs bending downward to align with the door frame.

13. The hidden furniture door hinge as claimed in claim 12, wherein the middle board further contains a plurality of directional tabs matching the plurality of grooves on the base board and a plurality of grooves matching the adjustable board.

14. The hidden furniture door hinge as claimed in claim 13, wherein two side-edges of the middle board bending downward forming a plurality of concave grooves to snap onto the base board.

15. The hidden furniture door hinge as claimed in claim 14, wherein the middle board is further connected and fastened to the base board by screwing a second cam screw to accomplish up and down adjustment.

16. The hidden furniture door hinge as claimed in claim 15, wherein the other two side-edges of the middle board contains flanges that can be used to snap the middle board into the adjustable board and slide with it.

17. The hidden furniture door hinge as claimed in claim 16, wherein the middle board is further connected and fastened to the base board by screwing a third cam screw to accomplish back and forth adjustment.

18. The hidden furniture door hinge as claimed in claim 17, wherein the cam screws are positioned as a triangle.

* * * * *